US005711160A

United States Patent [19]

Namisniak et al.

[11] Patent Number: 5,711,160

[45] Date of Patent: Jan. 27, 1998

[54] FOOD STORAGE TRACKING SYSTEM

[76] Inventors: Dianna Namisniak; Lee Namisniak, both of 22592 Le Dana, Mission Viejo, Calif. 92691

[21] Appl. No.: 592,544

[22] Filed: Jan. 26, 1996

Related U.S. Application Data

[63] Continuation-in-part of Ser. No. 239,981, May 5, 1994, Pat. No. 5,487,276, which is a continuation-in-part of Ser. No. 98,521, Jul. 28, 1993, Pat. No. 5,335,509.

[51] Int. Cl.[6] ..... G09F 9/00

[52] U.S. Cl. ..... 62/125; 116/308; 340/585; 368/106

[58] Field of Search ..... 62/125, 126, 127, 62/129, 157, 158; 116/307, 308, 205; 368/10, 89, 107, 108, 109; 283/55; 206/459.1, 459.5; 340/585, 588

[56] References Cited

U.S. PATENT DOCUMENTS

| | | | |
|---|---|---|---|
| 2,216,127 | 10/1940 | McNaught . | |
| 3,818,858 | 6/1974 | Kramer et al. | 116/133 |
| 3,837,104 | 9/1974 | Brotschi | 40/104.18 |
| 3,969,886 | 7/1976 | Yoda | 58/23 R |
| 4,005,571 | 2/1977 | Wolff | 58/39.5 |
| 4,292,916 | 10/1981 | Bradley et al. | 116/205 |
| 4,619,221 | 10/1986 | Linstromberg | 116/307 |
| 4,893,477 | 1/1990 | Vazquez | 62/125 |
| 5,129,536 | 7/1992 | Robinson | 220/211 |
| 5,335,509 | 8/1994 | Namisniak et al. | 62/125 |
| 5,487,276 | 1/1996 | Namisniak et al. | 62/125 |

FOREIGN PATENT DOCUMENTS

| | | | |
|---|---|---|---|
| 4-143574 | 5/1992 | Japan | 62/125 |
| 4-155169 | 5/1992 | Japan | 62/125 |
| 4-169773 | 6/1992 | Japan | 62/125 |
| 5-149670 | 6/1993 | Japan | 62/125 |
| WO9504344 | 2/1995 | WIPO . | |

*Primary Examiner*—Harry B. Tanner
*Attorney, Agent, or Firm*—Price, Gess & Ubell

[57] ABSTRACT

A method and device for ensuring the consumption of perishable food items before a useful storage lifetime for the items has elapsed. A base unit is mounted near, removably attached to, or on a food storage location such as a refrigerator, and allows identification and timing of the stored food items. When an item is placed into the storage location, its name and storage lifetime are recorded and displayed on the base unit. This recording may be accomplished manually by writing directly onto the base unit or by use of handwritten or preprinted magnetic labels, or recording may be accomplished electronically. A list, prestored in memory, of the most commonly stored food items and their approximate lifetimes is provided with the list configured for at least three food storage locations: a refrigerator, a freezer and a pantry. A numeric display is provided so that the length of time an item has been stored can be readily determined and compared with the useful storage lifetime. The base unit also provides electronic warning signals for each stored item. These warning signals, either visual or audible, alert the user as to those food items that have been stored close to the end of their useful storage lifetime and those that have been stored the full length or beyond their useful storage time thus helping the consumer to know which food items should be considered first for consumption to avoid their impending spoilage.

10 Claims, 5 Drawing Sheets

FOOD STORAGE TRACKING SYSTEM

This application is a continuation-in-part application under 37 C.F.R. §1.53 of U.S. Pat. No. 5,487,276 by the same inventors which was filed on May 5, 1994 as Ser. No. 08/239,981 which, in turn, was a continuation-in-part of Ser. No. 098,521, filed Jul. 28, 1993, U.S. Pat. No. 5,335,509.

BACKGROUND OF THE INVENTION

1. Field of the Invention

This invention relates to methods and devices to ensure the useful storage of food and, specifically, to a method and device to display the identity and storage time of food items in a refrigerator and to warn as to when those food items are approaching or have reached the end of their useful life.

2. Description of Related Art

Most people have discovered mold growing on food in a refrigerator. The common response is a slight shudder of revulsion followed by quick disposal of the offending item. Sometimes one does not discover the problem until the food is being prepared for consumption or is actually about to be eaten. If the spoilage is not readily visible, the tainted item may actually be eaten, with mild to severe medical consequences. Although the problem is most apparent with readily-perishable food in a refrigerator, food in a freezer, and even dried or canned food in a cupboard also deteriorated, albeit at a slower pace. The prior art solution to this pervasive problem has ranged from periodic disposal of all stored items to various lists attached to the front of the refrigerator or cupboard and manually maintained.

The problem with manual lists is that it is difficult to unambiguously identify the stored items. If one stored a piece of cheese in a refrigerator and wrote "cheese" on a list on the refrigerator door, confusion would result if there were more than one piece of cheese in the refrigerator. An attempt could be made to track the age of the particular item by also writing the date of storage on the list. Unfortunately, it is very difficult to look at such a list and immediately spot the item which is approaching the end of its useful life. When faced with a list of dates, the human mind does a poor job of instantly computing the current age of the item based on its date of storage. Also, most people do not have a clear idea of how long a given leftover should be stored. Furthermore, even if a leftover on the list is identified as approaching the end of its useful life, it is often difficult to easily locate the leftover in the refrigerator. Many perishable items cleverly hide on upper shelves or behind other items.

It is an object of the present invention to solve these common problems of food storage management;

It is another object to provide a method and device to furnish a food storage tracking system with a ready display of the names of the stored food items, an indication of how long such an item should be stored, and a display of how long each item has actually been stored; and It is a further object of the present invention to provide a warning when a food item is approaching or has reached the end of its useful lifetime and to provide a quick and simple way to locate a food item stored inside a crowded refrigerator.

OBJECTS AND SUMMARY OF THE INVENTION

The above objects and additional objects are met by a base unit that is designed to maintain both a list of the stored food items, including the recommended maximum storage period for each item, and a display that shows how long each item has been in storage and/or that warns when an item nears and then reaches the end of its storage life. Additionally, the invention may comprise an assortment of food storage containers made of plastic or some other suitable material. The storage containers are keyed to the list on the base unit. The base unit is a substantially flat device, more or less rectangular in shape, and would normally be about the size of a standard sheet of paper or smaller. It is designed to be removably attached to or placed in, on, or near the food storage location. For the base unit to be removably attachable, the back surface of the unit housing is equipped with magnets or magnetic sheeting. Because not all refrigerators have metal fronts, the unit also includes a hooking device or material such as "Velcro™" that can be adhered over (or instead of) the magnets or magnetic sheeting and then attached to the refrigerator. The current invention is designed to be powered by batteries, which is most convenient as it allows the base unit to become portable at any time. However, the power supply for the base unit is provided by house current when the base unit is constructed as part of a food storage location such as a refrigerator. Batteries are no longer needed, as the base unit can then draw power from the refrigerator's electrical power source.

The base unit performs three main tasks: a cataloging task, an associating task, and a timing task. Within the timing task, it also performs a warning task. The cataloging task can be thought of as a flexible form of list-keeping. The base unit has a number of item slots, each of which serves as a position for the entry of a potential item on a list. For example, a typical base unit might have 20 item slots. This means that the unit could simultaneously track about 20 food items. However, the base unit may also have only one item slot for tracking only one item, in which case the base unit is very small and is placed on or near the individual food item. The base unit allows the item slots to be reversibly filled so that the identity of a stored item or items can be flexibly maintained. In the simplest embodiment, an item slot would be a rectangular region on the smooth surface of the base unit. To add a newly-stored item of food to the list one would simply write the name of the item onto the slot with a dry-erasable felt marker pen. To delete an item (when the leftover has been removed from storage), the slot would simply be wiped with a paper towel or cloth to erase the name.

A slightly more advanced version of the invention provides preprinted food names which are printed on or laminated onto thin magnetic tabs. The base unit surface is Constructed with a magnetic material underlying the item slots, and the preprinted names can be removably attached to fill a slot. The unused names can be stored in alphabetical order on the face of the refrigerator with other refrigerator magnets. Custom items for which no preprinted tabs existed can be created by either writing directly on the base unit with an erasable pen, as already explained, or by writing on a blank magnetic tab. After the item is consumed, the tab can be erased so that another item name can be written onto it. Alternatively, the tab can be detached from the item slot and placed with the preprinted tabs so that the handwritten entry can be used again in the future.

In the most advanced version of the invention, the names of the stored items are provided by an electronic memory. A portion of the face of the base unit, including the item slots, is a display screen such as a liquid crystal display (LCD). An input device such as a keypad is also provided. By manipulating the input device, the name of the item of food to be stored is retrieved from the memory banks and displayed in one of the empty item slots on the face of the base unit. Several display slots can be provided, one for each food item to be displayed, or several stored items can be displayed in very few or only one display slot by activating a directional key on the keypad that "scrolls" the list on the display. An embodiment with a "scrolling" display is less expensive to manufacture and allows the unit to track an almost unlimited number of stored food items.

In the case of a small base unit designed to be placed on or near only one food item, the cataloging task, indicating the identity of the contents of the container, becomes optional and the base unit merely performs the timing and/or warning tasks.

It will be appreciated that the cataloging task explained thus far is much more flexible than list-keeping methods that are known in the prior art. Moreover, the cataloging task also encompasses a lifetime function. The lifetime function comprises a method of providing storage lifetimes for the perishable items to be stored. The simplest embodiment would be a printed list of the lifetimes. For example, green beans might have a storage life of five days. If the cataloging task were implemented by writing with an erasable pen on the front surface of the base unit, this lifetime "5" would be entered beside the name on the blank item slot. In the case of preprinted magnetic tabs, the recommended lifetime would come preprinted next to the name of the food item. Finally, more advanced implementations automatically provide the lifetime in memory along with the item name, and display both on an item slot.

The electronic memory has a data list of the most common leftover and perishable foods, along with their approximate lifetimes. The present invention includes at least three separate data lists in the base unit: one each for tracking food items in a refrigerator, a freezer, and a pantry. Three separate food storage inventory lists can be maintained by accessing these three separate data lists. It can be appreciated that more or less than three data lists can be included without departing from the scope of the invention. Custom or special items that are not already stored in the memory can be entered by the user by simply using the keypad. Any item that is entered via the keypad that is not already in the data list will automatically be added for future use.

If the user disagrees with a provided lifetime, the user may alter it by using the erasable pen with the magnetic tab version and/or entering a new lifetime number into the timing task with the "Lifetime Reset" function. The "Lifetime Reset" feature, when invoked, shows the original lifetime that was set, which can then be simply increased or decreased. The user next presses the Start button and the timer will continue to track time uninterrupted (i.e., the timers will not start over at zero).

Finally, many products such as yogurt or milk come from the store already marked with a preprinted expiration date. In that case, the user could write the date, in a numerical month/date format (i.e. 7/29 for July 29), on the base unit item slot (on a tab or directly on the surface, depending on the version of the invention) or enter it with the more advanced input device using an "expiration date" mode. Of course, it is understood that the actual final date for use of the item can be some days earlier or later than the printed date code based on when the container is actually opened for the first time. After the container has been opened, the item will then have an estimated lifetime. The user would simply start the timer from that point or would have to adjust the date accordingly, or such adjustment would be automatic in the more advanced version.

The second task is the association task. As explained above, a problem with keeping lists of stored items has been the difficulty of readily finding the item if it is in a closed container and of differentiating items if more than one example of a given item-type is stored at the same time. The association task provides an optional and added convenience to the present invention that solves this nagging problem. However, in the case of a small-sized base unit, as previously mentioned, which tracks only one item and is placed on or near the food item, the association task is not necessary. As already explained, the face of the full-sized base unit contains a column of item slots which are used to create a list of the stored items and display their storage lifetimes. Next to each item slot is a small identifier swatch panel. The identifier swatch panel provides a small patch of color or pattern for each and every one of the identifiers. Therefore, every item slot can be used with any identifier. Ideally, there would be between three and six different identifier colors or patterns.

The invention also comprises a series of food storage containers in a number of different sizes. These are ordinary, reusable containers of plastic or other suitable materials for storage purposes. However, each container prominently displays an identifier that matches one of the identifier swatches on the base unit. For example, the lids of the containers might match the color or pattern of a given identifier swatch. Reusable bands or disposable tapes that match identifier swatches can also be provided to mark prepackaged perishables such as yogurt or milk, if desired.

One begins the association task by choosing a storage container sized to fit the food item or an appropriate marking band and puts the item in the container or marks it with the band before putting the item into the refrigerator. Next, one chooses an empty item slot on the base unit. The user enters the name and lifetime into the slot with either the pen or by placing a magnetic label directly next to the identifier color or pattern that matches the already chosen container or marking band. With the more advanced version, the user enters a symbol, letter or word to represent the identifier. Now the entry on the list is associated with an item in the refrigerator or other storage location. Because the identifiers are of a bright color or pattern, one can easily locate the item within the refrigerator. As each stored item is consumed, its item slot is reclaimed by either erasing the handwritten label, removing the preprinted magnetic tab, or by operating the more advanced input device to clear the entry.

There is a tension between the number of different identifiers and the ease of locating an item. If there is a large number of different identifiers, it will be easy to locate a stored item, since there will only be one container in the refrigerator with that identifier. If there is a relatively small number of different identifiers, there is a good chance that there will be more than one container with a given identifier in the refrigerator at one time. However, a large number of different identifiers would require a prohibitively large number of food storage containers if there is to be a variety of sizes for each identifier. A choice of between three and six different identifiers results in a good balance between ease of locating an item and an excessive number of food containers. It should be noted that the association task relative to this invention is simply an added convenience to the functioning of the food storage tracking system and, therefore, is optional. It can be appreciated that the base unit and the scope of the invention is not diminished by the nonuse of special containers that are keyed to the food item list.

The way that the cataloging task creates a list of stored items, along with their storage lifetime and how the association task links the list entry with a particular stored item, has now been explained. The timing task completes the present invention. The timing task tracks and/or displays time information relative to each food item entered into the base unit. There are three possible timing modes: a "count up" mode that increments the number of days the item has been stored, a "count down" mode that decrements the preset lifetime entered by the user, and an "expiration date" mode. The user is able to select the desired mode through a switch or button, depending on the exact implementation. Generally, the entire base unit will operate in only one mode; it would be excessively confusing to use more than one mode simultaneously.

Within the timing task, the warning task is an integral feature of the invention. The warning task is accomplished by comparing the estimated lifetime information for a food item to the actual time the item has been stored. Warning signals alert the user as to those items that should be considered first for consumption in order to avoid their impending spoilage. When the elapsed time exceeds the lifetime shown on the item slot or when the expiration warning is given, the item has been stored beyond its useful lifetime.

The timing task can be carried out in several different ways. In one embodiment the timing task is executed by a series of electronic timing circuits, preferably with an electronic display for each item slot. The electronic display may be an actual numerical display of the elapsed time or alternatively, the display may simply be a warning signal that signifies the approach and then the expiration of the storage time. Associated with each item slot is one or more buttons or switches that activate, inactivate, or otherwise control the timing task for that particular item slot. Logically, the buttons or switches would be immediately adjacent to each display, but for economy they are often grouped on a keypad at a single location on the base unit, and a single button is used to control multiple slots (i.e., a given item slot is selected by entering its number on the keypad, and its display then activated by pushing a single activation button). In the simplest version, one or more timing circuits provide the timing functions with either a single or no numerical display of the elapsed time and/or a visually perceptible or audibly perceptible warning signal. In a simple microprocessor version, a single microprocessor provides all the timing functions with a single numerical display of the elapsed time and individual warning signals for each item slot. In the more advanced version of the invention, the timing display is actually part of the same screen that displays the item slots with their names, and each item has its own timing display and means for warning.

After the cataloging task and the association task have been completed (i.e., the item slot is filled in and the item is stored in an identifying container), the timing task is enabled: the timing display associated with the item slot is activated. In the simplest embodiment of the base unit that provides the warning feature, a "Day Set" function is provided in order to enter the lifetime information. After invoking an item slot, the user would press the "Day Set Up" button continuously until the desired lifetime number appeared in the display. A "Day Set Down" button is also provided to correct the display should the user push the "Up" button too many times and bypass the lifetime number desired. Once the desired lifetime is shown in the display, the user would invoke the timer for that item with either a master "Start" button or an individual item slot button. The base unit would then track the elapsed time since the item was placed in storage relative to the lifetime entered by the user. When the item is removed from storage and the item slot is cleared, the timing function is deactivated either by pressing the button a second time or, depending on the exact embodiment of the invention, pressing a special "Stop" button. With the more advanced microprocessor version of the invention, a master Start button is pushed once the desired food item name and its lifetime is retrieved from memory and displayed. When the item is removed from storage, the slot is selected and a "Stop" button is pressed to delete both the item name and the timing display.

The display shows elapsed time in appropriate timing intervals that match the lifetimes entered in the item slot. When the invention is used to track leftovers in a refrigerator, the timing increments are days. For the tracking of frozen or dried food, the increments are weeks or months. A particular base unit might display only one of the possible timing increments. Alternatively, a switch or switches could be provided that would alter the timing increments of individual or of all the displays on a base unit. The more advanced microprocessor version is most flexible and can automatically select and display the appropriate timing interval by selecting an appropriate storage location button marked (R) Refrigerator, (F) Freezer or (P) Pantry).

A warning signal that shows the status of the elapsed time is provided to alert the user when food items are approaching and/or have reached the end of their estimated storage lifetime. For example, when the food item has been stored within two days of its estimated lifetime, a warning signal would activate. For example, to alert the user, a visually perceptible signal such as a light would illuminate or an audibly perceptible signal such as an alarm or tone would sound. When the actual day of expiration arrived, a different warning signal would activate; for example, the display light would begin to flash or a different sounding alarm or tone would be heard. The warning signals would continue to alert the user until item is removed from the display.

An example might help clarify the functioning of the invention. In a version with multiple numeric displays operating in the "count up" mode (day increments), the timing display will show "0" when it is first activated. Preferably, this display would be next to the lifetime on the item slot. Thus, if the item were salad with a three-day lifetime, the item slot and timing display would look like this: "SALAD 3 0." Each day the timing display is automatically incremented by one day. After 24 hours, the slot and display will read: "SALAD 3 1." After three days, the display will match the lifetime number, indicating that the salad is at the end of its useful lifetime. The goal is to consume the salad before the timing display exceeds the lifetime. When the unit is operating in the "count down" mode, the timing display indicates how many days of useful life are left and would look like this: "SALAD 3 3." Each day the timing display is automatically decremented by one day. After 24 hours, the slot and display will read: "SALAD 3 2." After three days, the display will read "SALAD 3 0" indicating that the salad is at the end of its useful lifetime. The goal is to consume the salad by the time the display reaches 0.

In a version with a single numeric display and individual item slot warning signals, the display shows the number of days stored, or the number of days left, depending upon the timing mode selected, for only one selected food item at a time. The individual warning signals alert the user as to which items to consider first for consumption, those items with warning signals that are activated. The user can display the storage time information for any item desired at any time simply be selecting its item slot to be shown in the display.

Items such as milk or yogurt that have a month/day expiration date can be treated somewhat differently. Selecting the ""expiration date"" mode causes the timing display to show the month/day rather than just elapsed time. Thus, upon activation, the item slot and display would read: "YOGURT 7/15 7/12." The next day the line would read: "YOGURT 7/15 7/13." The actual useful storage time depends on the date the item is opened for the first time. Therefore, the printed date on a product can be earlier or later than this date. Thus, the date would then need to be adjusted accordingly. Then, when the display exceeded the adjusted lifetime, the product would have been stored beyond its useful lifetime.

The more advanced microprocessor version handles the process the most elegantly: the unit displays the time and warning information as explained above for each item slot individually. The user can select from a "count up," "count down," or "expiration date" mode. Furthermore, the food items are displayed in priority order with the food items that are closest to exceeding their estimated lifetime located at the top of the list. Consequently, these food items need to be considered first for consumption.

There will be times when the user forgets to enter a food item into the display at the time the item is placed into the food storage location. The current invention also provides an "Offset" function which solves this possible problem and will allow the timing task for a particular food item to begin from a number other than zero. For example, if the user realizes that she forgot to enter the tuna casserole onto the display when it was placed in storage two days ago, she can still track the food item's storage time from the day it was placed in the refrigerator by using the "Offset" function. After placing or entering the item's identity onto an item slot, the user would press the "Offset" button and then use the "DAY SET Up" button to increment the display to the number of days the item has already been stored, for example, 2 days. The user would next press the Start button and then proceed to enter the lifetime information in the normal manner and then push the Start button again to begin the timing task. The timer will now begin measuring time information from the number 2 instead of 0. The present invention has a sleep mode which simply turns off all timing and warning displays after approximately two minutes of nonuse. This is done to preserve battery life, however, all timing and warning functions continue to operate uninterruptedly.

The present invention helps to minimize loss of leftover, perishable, or dated foods through spoilage, thereby saving money. It also speeds meal planing and preparation by eliminating the need to open multiple containers to determine refrigerator inventory and by eliminating the need to cook an entire new meal by using foods already prepared. Furthermore, the inventory maintained through the cataloging task is a ready source of data for manual or automated production of shopping lists. As a food item is exhausted and removed from the food storage location, its identity can be transferred from the timing display to a shopping list display.

In a simple embodiment of the invention, this shopping list display can be a second metal based panel either attached or separate from the base unit with numerous item slots to receive the magnetic tab once it has been removed from the food inventory list's item slot. The magnetic tabs could also simply be placed in a list configuration at a separate location designated by the user on the face of the refrigerator. In the most advanced version of the invention, a separate "Misc." button, with the same functionality of the three food storage location buttons, is provided. This additional button can store a shopping list or any information the user desires. As a food item is exhausted and removed from the food storage location, its name can be transferred from one inventory list to another. In the same manner as the other three location functions, this "Misc." button/function also provides the timing and warning tasks. The user can customize a list of anything he or she desires, such as certain household tasks or responsibilities and assign a number of days in the future that she wants to be reminded or warned to complete the task.

For example, if the user wanted to be reminded to water the lawn on Monday and the current day is Friday, she would simply enter "water the lawn" as a custom item with a lifetime of three days into an item slot and invoke the timer. After three days, the warning feature would alert her that the time has expired and this would remind her to water the lawn. The warning would continue each day until the user removed the item from the item slot, preferably after having completed the task for which the user wished to be reminded. In this most advanced version, each of the four buttons functions in the same way, wherein custom items can be entered into memory at any time with any lifetime number to be used for providing a warning. It can be appreciated that the device can be used to track anything the user desires from food storage to household chores to electronic messages of any kind.

It can also be appreciated that, along with many current electronic devices, the base unit can be designed to be totally voice-activated. The technology exist for each and all of the current invention's functions to be designed with voice-activated controls and technology. This would make the device feasible for the blind or handicapped and provide them with great benefit.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide an overall method and devices for a food storage tracking system.

Figure 1:
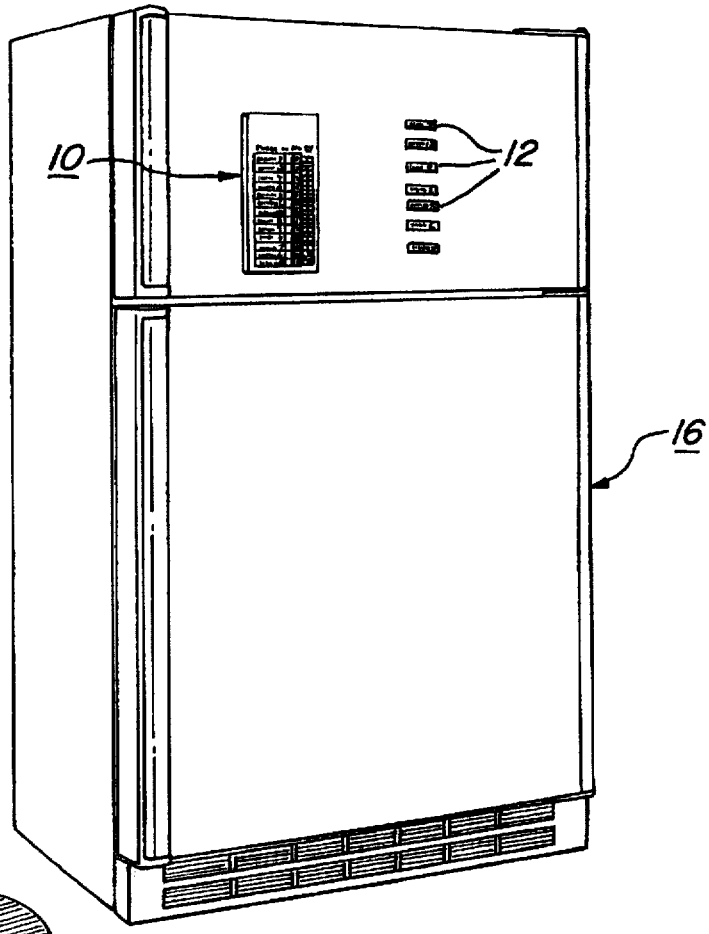
FIG. 1 is a perspective view of the magnetic tab version of the invention shown on a refrigerator.
Figure 5:
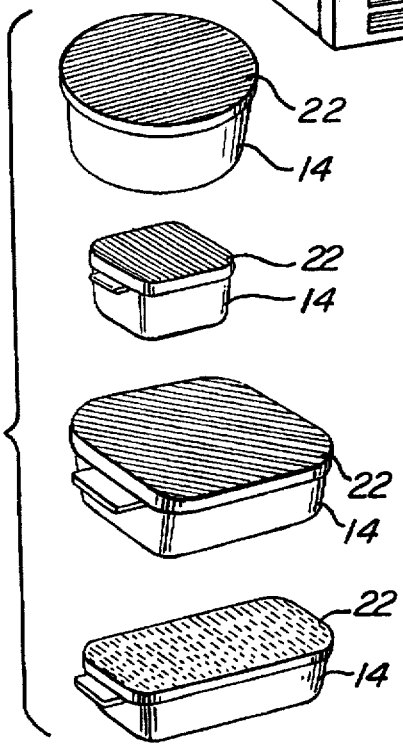
FIG. 5 shows a number of the identifier marked food storage containers.
Figure 3:
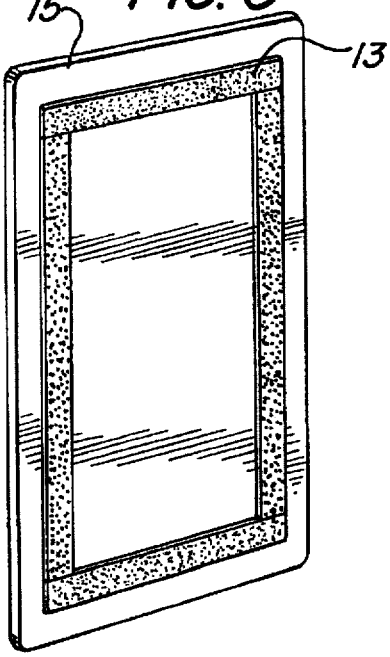
FIG. 3 is a diagram of the back surface of the magnetic tab embodiment of the present invention.
Figure 4:
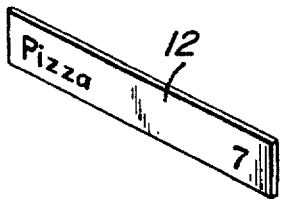
FIG. 4 is a representation of a single preprinted magnetic tab.

FIG. 1 shows the present invention in use. A base unit 10 is detachably mounted to the face of a refrigerator 16 by a magnetic, adhesive or hooking material such as Velcro™ 13 located on the back surface 15 of the unit (see FIG. 3). Also shown on the front of the refrigerator 16 are a number of magnetic tabs 12, one of which can be seen in FIG. 4, which are used in the cataloging task which is explained below. FIG. 5 shows several food containers 14 marked with identifiers 22 and suitable for use in the present invention.

Figure 2:
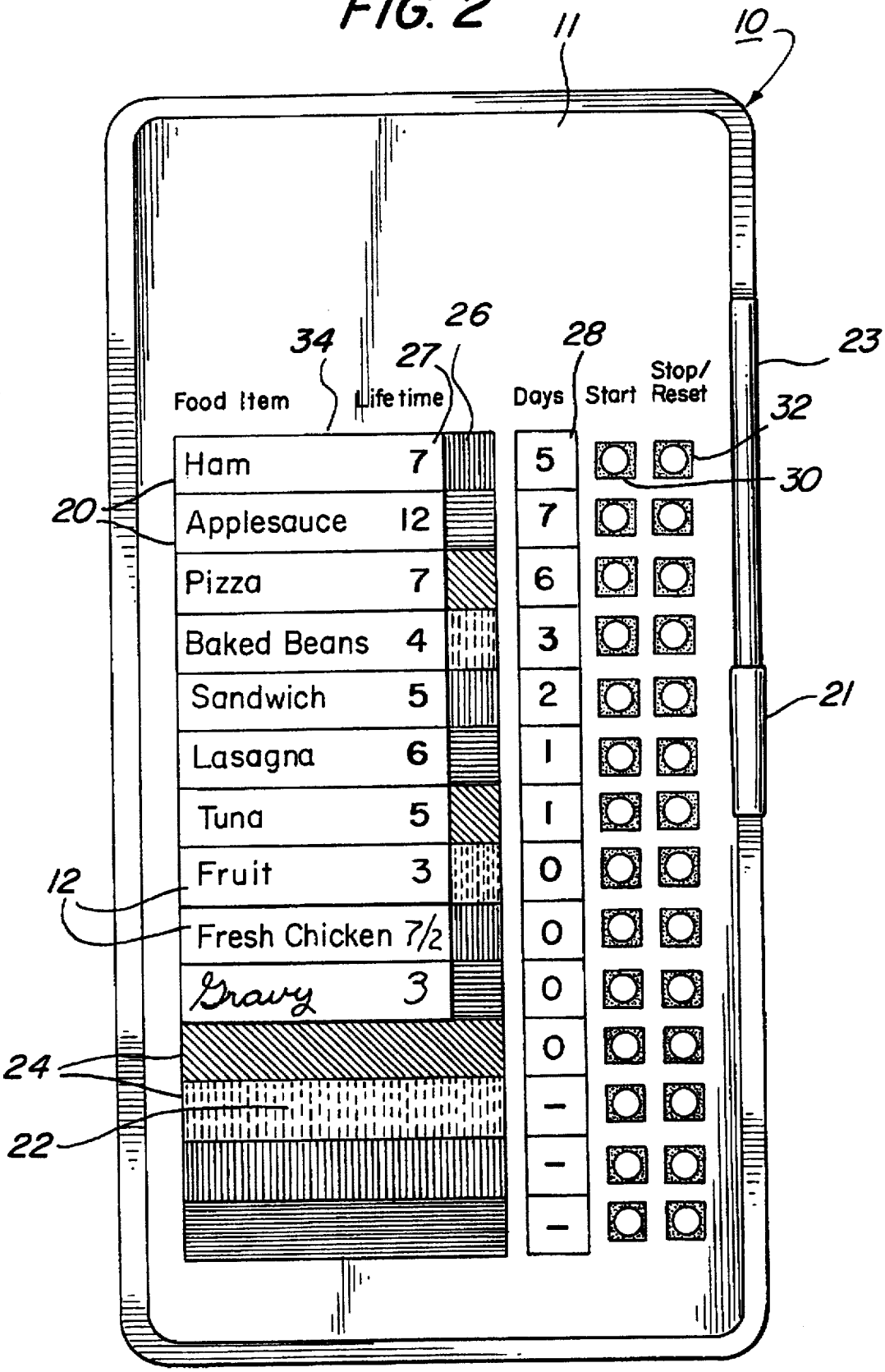
FIG. 2 is a diagram of the front surface of the base unit of the magnetic tab embodiment of the present invention.

FIG. 2 shows a view of the front surface 11 of the base unit 10 in the magnetic tab embodiment of the present invention, also shown in FIG. 1. The workings of the invention can be mostly explained by reference to FIG. 2. There is a holder 21 for a dry-erasable pen 23. There is a vertical column 34 of empty item slots 24. The surface of the item slot 24 is of painted or enameled steel or other magnetic material marked with an identifier 22. A preprinted magnetic tab 12 (see FIG. 4) can be removably attached to create a filled item slot 20.

The identifier 22 is preferably a color or a pattern and can be seen most readily in an empty item slot 24. A portion of the identifier 22 is also visible in the filled item slot 20 as an identifier swatch 26 because the tab 12 is not as long as the slot 24. As explained above, the optimal number of identifiers is between three and six. This will provide relative ease in locating a stored food item and still not require an excessive number of food storage containers. Ideally, there will be a choice of several different container sizes marked with each identifier.

Next to the identifier swatch 26 at the end of the item slot 20 is a timing display 28. The timing displays 28 form a vertical column, one for each filled item slot 20 and each empty item slot 24. Next to each timing display 28 is a Start button 30 and a Stop button 32. Like the timing displays 28, the buttons 30, 32 are arranged in vertical columns, with one Start button 30 and one Stop button 32 for each timing display 28. The timing displays 28 are attached to electronic circuits (not shown) within the base unit 10, and the buttons adjacent to each timing display control that particular display. Pressing the Start button 30 activates the adjacent display 28, causing it to display "0." Twenty-four hours later the display will increment to show "1." Pressing the Start button 30 a second time invokes the "expiration date" mode. This is used for products like milk that have a month/day expiration date. When the "expiration date" mode is activated, the display will show the month and day by alternately flashing the appropriate numbers. For example, if the date were July 15, the display would flash "7," followed by "/" and then by "15"; then the display would blank for a moment and then repeat the sequence. Pressing the Start button 30 a third time would invoke the "count down" mode. This is indicated by the display showing a flashing "1" rather than the date. In this mode the display decrements one day each 24 hours, rather than incrementing one day. Finally, pressing the Stop button 32 stops the clock and causes the display to show "--." The clock can be restarted by pressing the Start button. Pressing the Stop button 32 a second time resets the clock and deactivates the display, causing it to be entirely blank.

The details of the base unit 10 now having been explained, one can readily understand the functioning of the entire method. For example, suppose that one had a portion of baked beans that one wished to inventory and place into the refrigerator. One would first select an appropriately-sized food container 14 for the item to be stored, place the item into the container, and place the container into the refrigerator. One would then look at the base unit 10 to discover if there were an empty item slot 24 whose identifier swatch 26 matched the identifier 22 of the selected storage container 14. Assuming that there were an empty slot 24, one would then inspect the preprinted magnetic tabs 12 which are stored in alphabetical order on the front surface of the refrigerator 16 and select the tab 12 for baked beans. Alternately, if there were no preprinted tab 12 for baked beans, one would take the pen 23 and write "Baked Beans" on a blank magnetic tab 12 (or directly on the surface of the empty item slot 24). One would then place the magnetic tab 12 for "Baked Beans" onto the empty item slot 24, where it would adhere magnetically. The tab 12 is shorter than the empty item slot 24 so that a portion of the item slot identifier 22 shows as the identifier swatch 26 to the right of the magnetic tab 12. If, for some reason, one had decided not to use one of the identifier-coded food containers 14, this would be indicated by placing the magnetic tab 12 so that the identifier swatch 26 appears to the left of the tab 12.

At the right-hand end of the magnetic tab 12 is printed the item lifetime 27 (e.g. "4" for Baked Beans); farther to the right is the timing display 28 for that filled item slot 20. One activates the display 28 by pressing the Start button 30. The display 28 will increment each day. When the display 28 number exceeds the lifetime number, the baked beans have been stored beyond their useful life. If one selects the "count down" mode, one would then press the Start button 30 repeatedly until the display 28 shows the item lifetime ("4" in this case). The display 28 will decrement each day and flash to indicate the "count down" mode is in operation. When a negative number is displayed, the baked beans have been stored beyond their useful life. The advantage of the "count down" mode is that it is easy to see at a glance how many days of life are left for an item. If the expiration mode is selected, the item has been stored beyond its useful lifetime when the date flashed on the display 28 exceeds the expiration date written on the tab 12.

Figure 6:
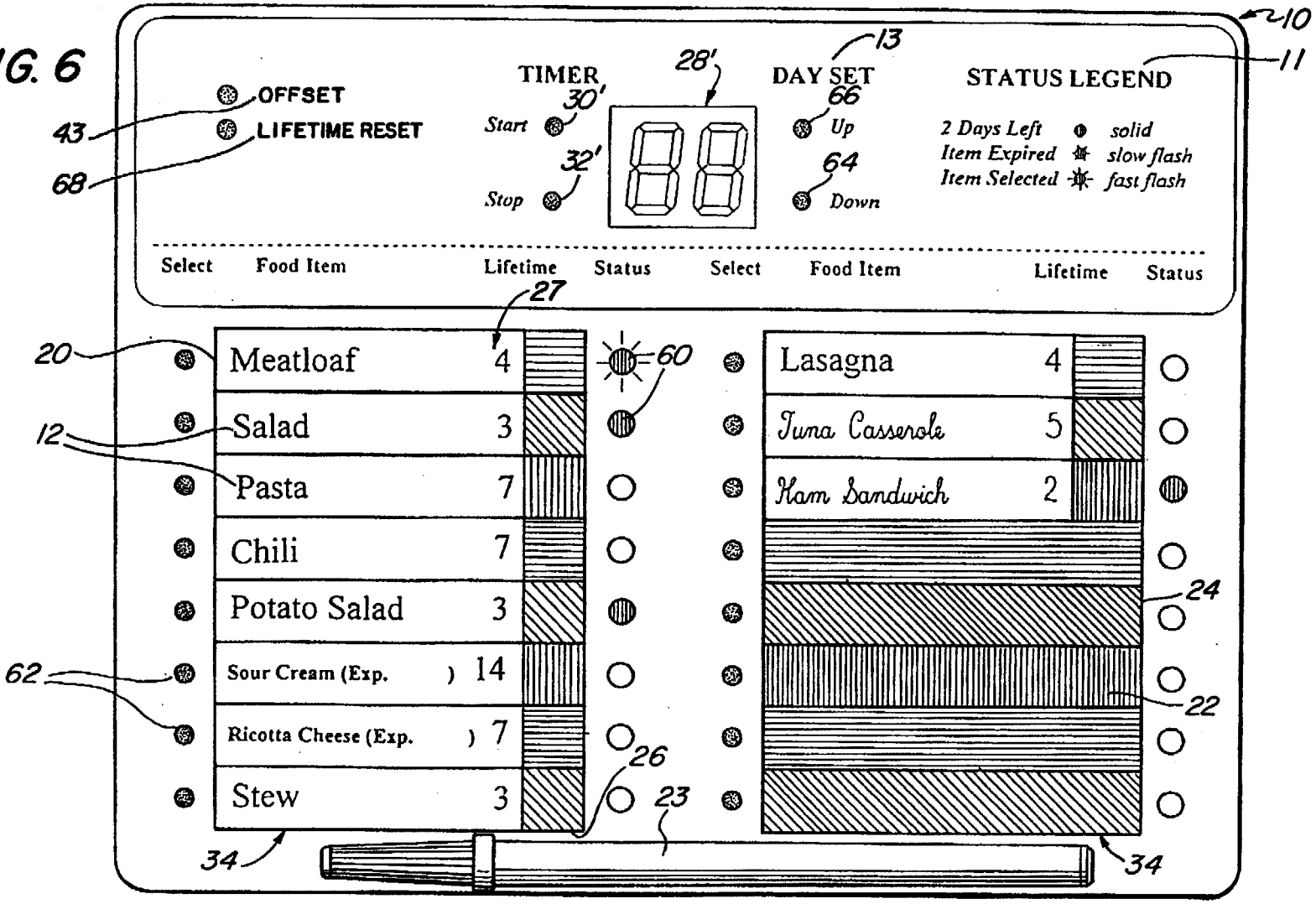
FIG. 6 shows a diagram of the front surface of a magnetic tab embodiment of a simple microprocessor version of the present invention in which the individual item displays are warning signals rather than numerical indicia and only one numeric display is provided.

FIG. 6 shows a magnetic tab embodiment of a simple microprocessor version of the present invention that has only one numeric display 28', but with individual warning signals 60 for each item slot. This unit is designed for more economy of cost with respect to LCD costs and also provides a means for warning. The base unit 10' is substantially similar to base unit 10 in FIG. 2. This version uses individual status LEDs (light emitting diodes) 60 for each item slot 24 rather than the individual numeric displays 28 of the embodiment shown in FIG. 2. Instead of individual Start buttons 30 and Stop buttons 32 for each item slot 24, this version has an individual Select button 62 for each item slot 24.

The cataloging task and the association task are carded out exactly as explained above for the embodiment shown in FIG. 2. For purposes of economy, the timing task is implemented slightly differently in this version. Instead of multiple timing displays 28, a single timing display 28' is provided. Instead of individual Start buttons 30 and Stop buttons 32, a master Start button 30' and a master Stop button 32' are provided. A further simplification in which no numeric display is provided is also possible.

To invoke the timing task, a filled item slot 20 is selected by pressing the associated Select button 62. The selection is then indicated by the associated status LED 60 which begins to flash rapidly. The single numerical display 28' is then adjusted to show the lifetime number provided on the tab 12. An Up button 66 and/or a Down button 64 are used to set the lifetime on the single display 28'. Finally, the master Start button 30' is pressed to start the timing function.

During normal use no item slot 24 will be selected and the single display 28' will be blank. The microprocessor, however, will track the set lifetime and timing information for all item slots. When only two days of life remain for an item, its status light 60 will illuminate. When the item actually expires, the status light 60 will begin to flash slowly. At any time, a filled item slot 20 may be selected by pressing its individual Select button 62. When the filled slot 20 is selected, the single display 28' will display the remaining lifetime when in the "count down" mode or the total days stored when in the "count up" mode for the item. When the item expires or is consumed, the filled item slot 20 can be cleared by pressing the Select button 62 for the slot and then the master Stop button 32'.

Because estimated lifetimes 27 for food items will usually be quite conservative, the warning signals may activate well before the food item is actually close to spoiling. As a result, a user may wish to change a lifetime number 27 after the timer has been activated in order to temporarily remove and/or delay the warning signal 60 from illuminating until a later time. In order to accomplish this, the user would simply activate the desired food item's slot by pressing its Select button 62 and then pressing the Lifetime Reset button 68. The display 28' will show the original lifetime set and the user would then press the Up 66 or Down 64 button to display the new desired lifetime. If the user wished to change the lifetime without the Lifetime Reset 68 function, the timer would reset and start over at zero after entering an adjusted lifetime figure. The user would then not know how many days the item has been actually stored. Therefore, the Lifetime Reset feature enhances the functionality of the device.

The Offset feature 43, also enhances the functionality of the device and is provided so that any food item can be timed beginning from a number other than zero. Should the user forget to enter a food item into the base unit at the time it was placed into storage, it can be entered later using the Offset feature 43. After entering a food item name, the user presses the Offset button 43. Then the user enters the number of days (weeks, or months depending on the storage location) that the food item has already been stored, for example two days. Then the user presses the Start button 30' and proceeds to enter the lifetime number in the normal manner; after which the user presses the Start button 30' a second time. The timer for this particular item slot now begins measuring time from 2 days instead of from 0.

Figure 7:
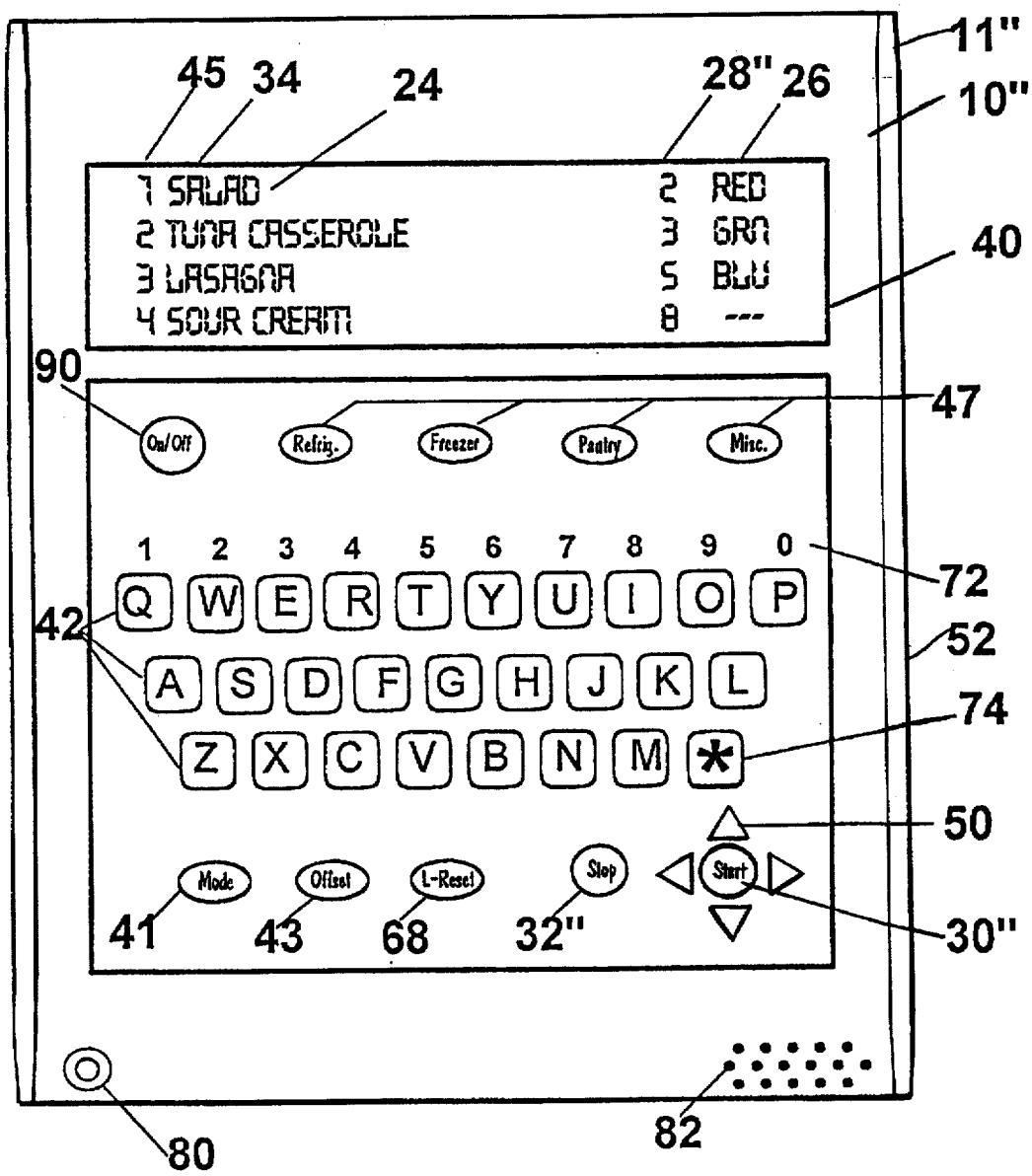
FIG. 7 is a diagram of the front surface of the base unit of the more advanced microprocessor embodiment of the present invention.

FIG. 7 shows the more advanced microprocessor version of the current invention. An LCD screen 40 is provided to display individual item slots 24 which eliminates the need for magnetic tabs. A scrolling four-line LCD 40 is used in this embodiment for economy. Each item slot 24 is numbered at its left-hand end 45. At the right-hand end of the screen is a vertical column of timing displays 28". To the right of the timing displays is a vertical column of identifiers 26. Below the LCD 40 is a keypad input 42, an On/Off button 90, food storage location keys 47, a Mode button 41, an Offset button 43, a Lifetime Reset button 68, a Start button 30", a Stop button 32", and directional input keys 50. At the bottom of the unit is a microphone 80 and a speaker 82 used when the base unit includes voice activated technology. The base unit 10" is fabricated as a single-board microcomputer. A low-power CMOS (complementary metal oxide semiconductor) microprocessor with integral EPROM (erasable programmable read only memory) is employed. A smart peripheral capable of storing up to 8,000 bytes of data can also be used. A small lithium battery provides backup for a clock/calendar RAM (random access memory) chip, if needed. The LCD screen 40 forms a vertical column of item slots 34 and is mounted directly to the circuit board, as is the membrane-switch keypad 42, and all other function keys. A molded plastic case 52 with cutouts for the screen 40, keypad input 42, and other function keys encloses the circuit board. Power is provided by batteries or, alternately, by the refrigerator 16 itself with the base unit 10 being constructed as part of the refrigerator 16.

All the functions of the manual/magnetic tab version 10, 10' of the invention are implemented through software in the more advanced microprocessor version 10". The overall method of using the unit 10" is essentially the same. However, the user first selects the desired timing mode by depressing the Mode button 41. The display will show (U) for "Count Up," (D) for "Count Down," or (E) for "Expiration Date." Once the mode is selected, it does not have to be selected again unless the user wishes to start all inventory lists anew using a different mode. After the food item is placed in a container 14, the cataloging task inputs the item name and lifetime. To accomplish this, one selects the food storage location list 34 by depressing one of the four storage location buttons 47: (R) for the refrigerator, (F) for the freezer, (P) for the pantry, and (M) for Miscellaneous. The appropriate inventory list 34 is displayed and the cursor is placed at the beginning of the first item slot 24. To enter a new item, the user presses the directional keys 50 to move the cursor to the first empty item slot. Moving the cursor on the display can be accomplished more quickly by pressing the "Star" key 74 while simultaneously pressing the direction key 50 which causes the display to move four lines at a time when moving up or down or a column at a time when moving left or right. Next the user simply presses the first letter of the food item to be entered using the keypad 42. The unit's ROM (read only memory) contains more than 100 items along with their approximate lifetimes for each storage location. For example, if one pressed "A," the first ROM item starting with "A" would appear in the empty item slot. In this example, that would be "APPLE." If that is not the desired item, then the second letter of the name can be pressed, and the first item that has those two letters will appear. This is continued until the desired name appears.

If the name is not found, it can be entered by typing out the entire name on the keypad 42. If the item is in the ROM, the lifetime is automatically retrieved from memory and appears in the timing display 28". The lifetime number will represent "days" for item names retrieved or entered into the (R) Refrigerator or (M) Miscellaneous inventory list, "weeks" for those retrieved or entered into the (F) Freezer list and "months" for those in the (P) Pantry list. If the item is a newly-entered custom item, "?" flashes in the timing display 28", indicating that the operator must enter a lifetime. The suggested lifetime may be increased or decreased by pushing the "Up" or "Down" arrow keys of the directional input 50 or by entering a new number with the keypad 42. Entering numbers with the keypad 42 is accomplished by pressing the "Star" key 74 while pressing the letter key directly below the number 72. Custom entries are automatically and permanently saved in an on-board nonvolatile memory. Custom items can be any item or event the user wishes to enter and the user can assign any lifetime number for the purpose of a future warning. Miscellaneous custom items such as a reminder to "water the lawn" or "take out the garbage" would normally be entered in the (M) Miscellaneous storage location 47.

Once the desired item name and lifetime appears in the display 24, the user next presses the master Start button 30" to begin the timing task. The timer tracks the time information and displays it, instead of the lifetime number, in the timing display 28". This timing information is displayed in the proper format depending upon the timing mode selected and the location button 47 depressed.

The warning task can be implemented in several ways. First, each time the base unit is activated the item lists 34 are sorted and later displayed in priority order with those food items needing to be considered first for consumption at the top of the list. The simplest visual warning signal is provided by the item name 24 which flashes to alert the user that the item is approaching the end of its useful life. For example, the item name 24 would flash once the item has been stored within two days of its estimated lifetime. Once the item has exceeded its estimated lifetime, the storage time number 28" would also flash. The warning signals can also be symbols (not shown) that appear in the display 24, 28" for each item as it approaches or exceeds its estimated lifetime. The warning signals can also be different sounds (alarms, tones, or voice) that are associated with each item slot and type of warning and are heard through the speaker 82.

The association task is optionally implemented by entering a color, symbol, letter, or word that represents the appropriate food storage container 14 identifier 22 into the provided column 26. For example, the user could enter the letter B and the word Blue (or the color blue, depending on the type of LCD used) would be retrieved from memory and appear in the display.

Any item slot 24 can be selected with the directional input keys 50 or by entering its slot number 45 so that it is easy to modify the line or to clear the slot 24 when the stored item is consumed by pushing the Stop button 32". If the user then wishes to transfer the consumed item name to the (M) Miscellaneous 47 food storage location feature for the purpose of generating a shopping list, the user would simply push the (M) Miscellaneous button 47 while also pressing the Stop button 32". By pushing both buttons 47 and 32" simultaneously, the item name is removed from one list and added to the other. This can also be done should the user take something from the freezer or pantry and then place it in the refrigerator after the item was opened and/or cooked. The item could simply be transferred from one list to the other. The battery-backed clock/calendar records the identity and timing status of each item so that power interruptions will not cause a loss of data. The Offset key 43 and the Lifetime Reset 68 function in the same manner as described for FIG. 6.

Figure 8:
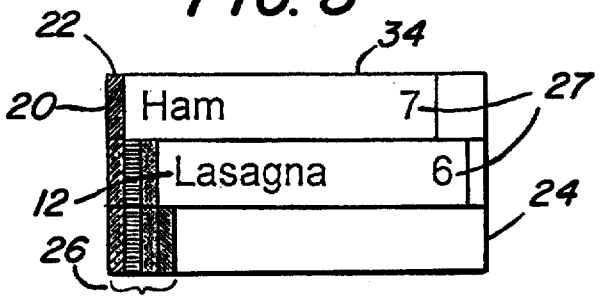
FIG. 8 shows a diagram of a cross section of the front surface of a magnetic tab embodiment wherein a "panel" of identifier swatches is presented instead of only one identifier swatch per item slot.

FIG. 8 presents an alternative embodiment of the identifier swatch panel for the magnetic tab embodiments of the base unit. It has been found that the user can run out of empty slots 24 to match the container identifier 22 when the identifiers are configured with only one per item slot as in FIGS. 2 and 6. Therefore, the identifier swatch in FIG. 8 is presented as a "panel" of all identifier swatches 26 for each item slot. This allows the user to select from any empty item slot 24 rather than only from a reduced number of slots that match the container. The user places the magnetic label 12 immediately adjacent to the color or pattern 22 that matches the container and can later refer to this color or pattern 22 when attempting to locate the container in the refrigerator.

Figure 9:
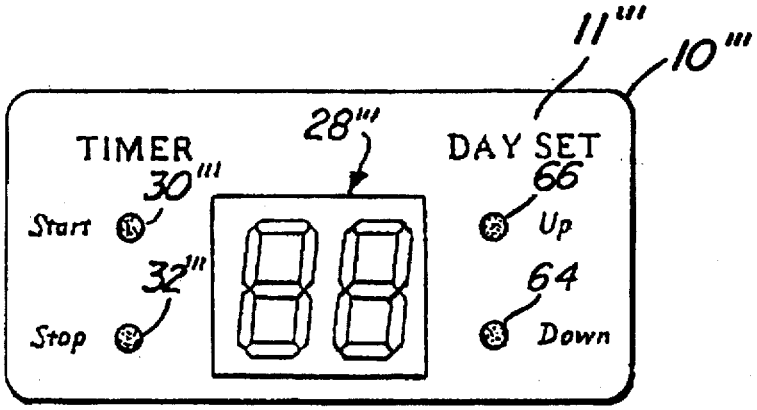
FIG. 9 shows a diagram of the front surface of an embodiment sized to track only one item wherein the base unit is placed on or near the stored food item.
Figure 10:
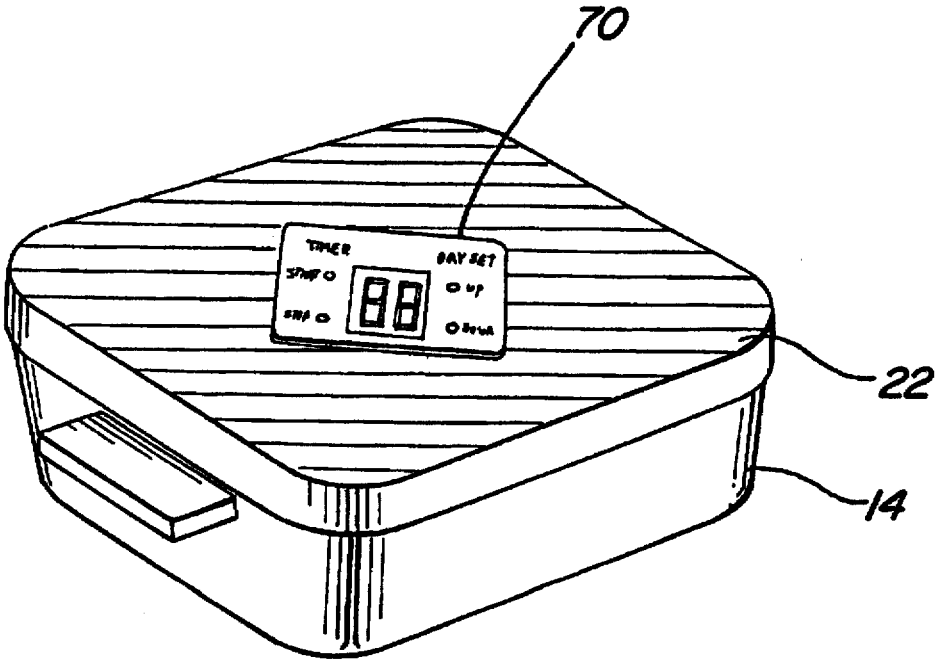
FIG. 10 shows a diagram of the embodiment presented in FIG. 9 in actual use having been placed on top of a food storage container.

FIG. 9 shows a diagram of the front surface of an embodiment sized to track only one item wherein the base unit is placed on or near the stored food item. The base unit is small in size, approximately 3"×1½," and affords great economy of cost. Several low cost units can be purchased and used over and over. The front surface 11'" of the base unit 10'" is exactly the same as the top portion 13 of the device presented in FIG. 6. Individual item slots and individual warning signals are not included as this smaller device only tracks one item and, therefore, the cataloging and association tasks become unnecessary. The user simply enters the food item's lifetime, obtained from a separate list, using the Up 66 and Down 64 keys and then presses the Start button 30'". The device is then removably attached to the top 70 or near the stored food item as shown in FIG. 10. The base unit is designed with technology to function properly in cold temperatures. The warning task is still provided with a slow flashing of the time display 28'" when the item has been stored within two days of its estimated lifetime and with a fast flashing of the time display 28'" when the item has reached the end of its estimated lifetime. The warning signals can also be sounds (alarms, tones or voice) associated with each type of warning. After an item is removed from storage, the base unit 10'" is reset and can be used again. A base unit with audible warnings can be designed to be photo or light sensitive wherein the warning signals sound off when exposed to light, for example, when the refrigerator or freezer door is opened. The technology for photo sensitive electronic devices already exists.

It can be appreciated that within the scope of the present invention, the base unit 10, 10', 10", 10'" can be designed without the lifetime and warning functions and simply be a device that tracks elapsed time in timing increments of days, weeks, and/or months and removably attached or placed near the stored food item or items.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A food storage tracking system, comprising:

a base unit;

a time measuring device for providing time information in the base unit;

storage means in the base unit for storing the identity and storage lifetimes of a plurality of food items;

input means in the base unit for selecting one of the food items in said storage means;

electronic means in the base unit for starting said time measuring device for the selected food item comparing the time information generated for said selected food item with the storage lifetime of the selected food item and generating a signal responsive to the comparison; and a display on the base unit communicating with said electronic means for displaying the storage lifetime remaining for a selected food item in storage in response to the signal from said electronic means.

2. The food storage tracking system as defined in claim 1, wherein the electronic means generates the signal at a predetermined time before the storage lifetime of the selected food item has expired.

3. The food storage tracking system as defined in claim 1, wherein the electronic means generates the signal when the storage lifetime of the selected food item has expired.

4. The food storage tracking system of claim 2 or 3, wherein the display produces a visually perceptible warning in response to the signal.

5. The food storage tracking system of claim 2 or 3, wherein the display produces an audibly perceptible warning in response to the signal.

6. The food storage tracking system of claim 5, wherein the audibly perceptible warning comprises an alarm tone, a series of tones, or a voice.

7. The food storage tracking system as defined in claim 1, wherein the base unit is constructed as part of a food storage location.

8. The food storage tracking system of claim 1 further comprising means for maintaining a plurality of distinct lists of a plurality of food items in said storage means.

9. The food storage tracking system of claim 8 wherein each distinct list relates to a different storage location for the food items on that list.

10. The food storage tracking system of claim 9 further comprising means for moving a food item from one list to another.

* * * * *